US010253501B2

(12) United States Patent
Mauz et al.

(10) Patent No.: US 10,253,501 B2
(45) Date of Patent: Apr. 9, 2019

(54) SPACER FOR A REINFORCEMENT LAYER, REINFORCEMENT SYSTEM FOR A CONCRETE COMPONENT, AND METHOD FOR THE PRODUCTION OF A REINFORCEMENT SYSTEM

(71) Applicant: Solidian GmbH, Albstadt (DE)

(72) Inventors: Uwe Mauz, Schwenningen (DE); Jochen Keinath, Winterlingen (DE); Johann Pfaff, Winterlingen (DE)

(73) Assignee: Solidian GmbH, Albstadt (DE)

( * ) Notice: Subject to any disclaimer, the term of this patent is extended or adjusted under 35 U.S.C. 154(b) by 0 days.

(21) Appl. No.: 15/022,873

(22) PCT Filed: Sep. 3, 2014

(86) PCT No.: PCT/EP2014/068715
§ 371 (c)(1),
(2) Date: Mar. 17, 2016

(87) PCT Pub. No.: WO2015/039869
PCT Pub. Date: Mar. 26, 2015

(65) Prior Publication Data

US 2016/0222663 A1 Aug. 4, 2016

(30) Foreign Application Priority Data

Sep. 18, 2013 (DE) ..... 10 2013 015 434

(51) Int. Cl.

| | |
|---|---|
| ***E04C 5/16*** | (2006.01) |
| ***E04C 5/20*** | (2006.01) |
| *E04C 5/07* | (2006.01) |

(52) U.S. Cl.
CPC ..... *E04C 5/168* (2013.01); *E04C 5/167* (2013.01); *E04C 5/20* (2013.01); *E04C 5/203* (2013.01); *E04C 5/206* (2013.01); *E04C 5/07* (2013.01)

(58) Field of Classification Search
CPC . E04C 5/168; E04C 5/167; E04C 5/20; E04C 5/206; E04C 5/203; E04C 5/07
(Continued)

(56) References Cited

U.S. PATENT DOCUMENTS 1,775,234 A * 9/1930 Brostrom ..... E04L 31/161 52/324
2,116,335 A * 5/1938 Bosco ..... E04C 5/18 52/647
(Continued)

FOREIGN PATENT DOCUMENTS

CA 1005254 A 2/1977
CN 202031252 U 11/2011
(Continued)

OTHER PUBLICATIONS

International Search Report for corresponding International Application No. PCT/EP2014/068715, dated Nov. 28, 2014, 6 pages.
(Continued)

*Primary Examiner* — Joshua K Ihezie
(74) *Attorney, Agent, or Firm* — Fitch, Even, Tabin & Flannery, LLP

(57) ABSTRACT

The invention relates to a spacer (1) for a reinforcement layer (16), a reinforcement system (29) for a concrete component (21), and a method for the production of a reinforcement system (29).
The spacers (1) described allow especially mesh-type reinforcement layers (16) to be kept at a distance from other bodies (24, 28) in a particularly simple manner. The spacers
(Continued)

(1) are fitted by inserting them into a mesh (8) of the reinforcement layer (16) and connecting them thereto by twisting.

13 Claims, 7 Drawing Sheets

(58) Field of Classification Search
USPC ..... 52/687, 677
See application file for complete search history.

(56) References Cited

U.S. PATENT DOCUMENTS

| | | | | | |
|---|---|---|---|---|---|
| 2,297,963 | A * | 10/1942 | Kroll | A47D 7/03 | 5/11 |
| 4,408,748 | A * | 10/1983 | Lewis | E04H 17/24 | 256/11 |
| 4,575,985 | A * | 3/1986 | Eckenrodt | E04C 5/20 | 52/677 |
| 4,598,523 | A * | 7/1986 | Tolliver | E04C 5/20 | 52/685 |
| 4,802,248 | A * | 2/1989 | Moroney | A47D 7/03 | 5/11 |
| 4,900,184 | A * | 2/1990 | Cleveland | E04C 5/168 | 24/339 |
| 5,291,715 | A * | 3/1994 | Basile | E04C 5/203 | 52/687 |
| 5,996,297 | A * | 12/1999 | Keith | E04C 2/044 | 411/456 |
| 6,279,274 | B1 * | 8/2001 | Amiet | E04C 5/168 | 52/125.2 |
| 6,637,171 | B1 * | 10/2003 | Toone | E04C 5/168 | 248/156 |
| 8,844,224 | B2 * | 9/2014 | Lindquist | E04C 5/16 | 52/294 |
| 2002/0112437 | A1 * | 8/2002 | Queen | E04C 5/166 | 52/677 |
| 2003/0197108 | A1 * | 10/2003 | Domizio | E04C 5/203 | 248/519 |
| 2004/0099785 | A1 * | 5/2004 | Juedes | E04C 5/163 | 249/207 |
| 2010/0154323 | A1 * | 6/2010 | Ruland | E04F 15/02447 | 52/126.6 |
| 2010/0300033 | A1 * | 12/2010 | Trangsrud | E04C 5/168 | 52/685 |
| 2011/0219721 | A1 * | 9/2011 | Densmore | E04C 5/168 | 52/687 |

FOREIGN PATENT DOCUMENTS

| | | | |
|---|---|---|---|
| DE | 6605522 | U | 6/1970 |
| DE | 2305954 | A | 1/1974 |
| DE | 3545920 | A1 | 6/1987 |
| DE | 8903324 | U1 | 5/1989 |
| DE | 19522280 | A1 | 1/1997 |
| DE | 102012004785 | A1 | 9/2013 |
| GB | 2123455 | A | 2/1984 |
| GB | 2399108 | A | 9/2004 |
| JP | H0561316 | U | 8/1993 |
| JP | H0587115 | U | 11/1993 |
| JP | H0734465 | A | 2/1995 |
| KR | 2002312210000 | U | 7/2001 |
| KR | 2020100005714 | U | 6/2010 |
| WO | 9960224 | A2 | 11/1999 |
| WO | 2011031300 | A1 | 3/2011 |

OTHER PUBLICATIONS

International Preliminary Report on Patentability for corresponding International Application No. PCT/EP2014/068715, dated Nov. 26, 2015, 6 pages.
Office Action in corresponding Korean Application No. 10-2016-7009489, dated Jun. 30, 2016, 14 pages.
First Office Action and Search Report in corresponding Chinese Application No. 201480051670.4. dated Aug. 24, 2016, 15 pages.
Notification of Reasons for Refusal in corresponding Japanese Application No. 2016-515512, dated Aug. 15, 2016, 4 pages.
German Office Action dated Jul. 9, 2014, for corresponding DE Application No. 1020130154340, with Machine English Translation (12 pgs.).

* cited by examiner

SPACER FOR A REINFORCEMENT LAYER, REINFORCEMENT SYSTEM FOR A CONCRETE COMPONENT, AND METHOD FOR THE PRODUCTION OF A REINFORCEMENT SYSTEM

The invention relates to a spacer for a reinforcement layer, a reinforcement system for a concrete component, and a method for the production of a reinforcement system. Reinforcement systems may consist of construction steel. To an increasing extent, however, they feature reinforcement structures made of fibrous material. The reinforcement system may feature one reinforcement layer or a plurality of mutually spaced reinforcement layers. During production of a fibre-reinforced concrete element such as a precast concrete member, the position of the reinforcement has to be specified and maintained while the concrete is being poured. Spacers that define the distance between two reinforcement layers and/or the distance between a fibre reinforcement and an exterior surface of the fibre-reinforced concrete element produced are used for this purpose.

A spacer intended particularly for use in connection with fibre reinforcement layers is known, for example, from the internet publication www.disttex.com. The spacer has a pyramid-shaped cap and two mutually parallel legs extending from a flat side of the cap. A segment of a fibre strand of a fibre reinforcement may be accommodated in the gap between the two legs. The spacer may be fixed onto the fibre-strand segment in the manner of a peg. In another embodiment of the spacer, two fibre-strand segments of two fibre reinforcement layers are accommodated between the two legs. On the side opposite the cap, a closure piece closes the space between the two legs. In order to maintain the distance between the two fibre-reinforcement layers, the legs may be pushed through a hole in a distancing piece located between the two fibre-strand segments of the two fibre-reinforcement layers.

Another spacer is known, for example, from the DE 23 05 954 A. The spacer has a hollow body featuring one or more screw slots extending towards an opening in the hollow body. The spacer with the hollow body may be pushed by way of the opening therein onto a steel reinforcing member and locked onto it in the form of a bayonet joint by twisting. In other words, the spacer can be screwed and latched onto a steel reinforcing member.

The DE 89 03 324 U1 discloses a spacer that may be pushed on at a cross-over point between two intersecting rods of the reinforcement and latched by way of twisting. The spacer has a receiving portion for this purpose, which is delimited by two mutually opposite and mutually spaced retaining elements. The retaining elements, each of which is approximately semi-circular, are bent in opposite directions. Between the two retaining elements, a profiled passageway is formed in the direction in which a rod to be received extends. A groove is configured at right angles to this profiled passageway in a retaining surface adjacent to the receiving portion. The spacer may be pushed onto a cross-over point between two rods and locked by twisting in such a way that the one reinforcing rod comes to lie in the groove whilst the other reinforcing rod is embraced from opposite sides by the two retaining elements. If the two reinforcing rods are clamped one on top of the other by the retaining elements, the groove will prevent the spacer from being accidentally twisted and released. A spacer operating in the same manner is also shown in WO 2011/031300 A1 or in WO9960224A2.

The DE19522280A1 discloses a spacer especially adapted for spacing reinforcing rods of reinforcing grids and reinforcing lattice girders perpendicular to each other to a formwork. The reinforcement rods are pushed in from "above" and get secured by tight fit for example.

A further embodiment of a spacer is disclosed in the DE 66 055 22 U1. The various embodiments are secured to a section of a reinforcing member by means of a flexible latching element resembling a cable tie.

The US 2011/0219721 A1 discloses a spacer which can be secured in a mesh of a reinforcing grid by rotation. The spacer comprises four grooves facing away from a principle axis of rotation in radial direction. The spacer in inserted into the mesh in an orientation of 45° of the grooves to the rods of the grid. As far as the grooves reach the position of the rods in the height direction the spacer is rotated 45° for fixation in the mesh. The suitable axial position of the spacer for starting the rotation is not indicated by an interaction of the spacer and the mesh. Spacers operating in a similar manner and showing the same drawback are also shown in CN202031252U and in DE3545920A1.

The objective is to provide an alternative embodiment of a spacer, based on these known spacers, which is very easy to attach to a reinforcement and is also suitable for arrangement between two mutually parallel strands of a fibre reinforcement and/or rods of a metal reinforcement.

This objective is established by a spacer according to claim 1, by a reinforcement system for a concrete component, as set forth in claim 8, and by a method for the production of a reinforcement system, as set forth in claim 11.

The spacer according to the invention serves for the production of a reinforcement system and may also be connected to a reinforcement by applying torque to the principal axis of rotation, which runs predominantly in the axial direction. Frictional and/or form-fitting connections are created (see below for further details).

The spacer is preferably suitable for spacing at least one reinforcement grid, preferably a prefabricated grid made up of permanently connected fibre strands or rods. The reinforcement grid is advantageously spaced from one or more other bodies. These bodies may include further reinforcement grids and formwork components. The distancing body is directly involved in adjusting the distance between the reinforcement grid and this at least one other body. As used in this publication, the expression "distancing body" is a functional term that indicates which part of the spacer is mainly responsible for "adjusting the distance". A distancing body of such kind may, of course, also serve to suspend the grid from above.

The spacer includes a securing system, which is connected to the distancing body and carries the connecting elements. The connecting elements can be connected with the strands or rods of a first reinforcement layer. As a rule, the securing system is inserted into spaces in the grid known as grid meshes. These grid meshes generally lie in a first plane, into which the at least one securing system is then brought.

It will become clear later on that this plane runs substantially in the spacer's peripheral and radial directions (cylindrical coordinates are used).

The connecting elements mentioned have grooves featuring a groove bottom and a first and second groove wall. The groove's longitudinal axis runs by and large in the spacer's peripheral direction, with the groove opening pointing substantially in the direction of the spacer's positive radial direction.

If, on insertion of the spacer, the securing system is brought into the plane of the reinforcement, the groove axes and the groove bottom will also lie in this plane. In this situation, the spacer can then be twisted such that strand or rod sections are received into the at least one groove. The strand- or rod-section sites received into the groove in this way are referred to in this publication as connection sites.

The axis about which the spacer is twisted for this purpose may be located according to the geometric requirements by a person skilled in the art. It is to advantage if it runs largely at right angles to the reinforcement plane and through the centre of the mesh into which the spacer is inserted. It is further to advantage if this principal axis of rotation of the spacer runs through the centre thereof in the spacer's vertical direction. In the case of two connecting elements, the centre is half way between the groove bottoms of the two securing elements. If four connecting elements are provided, two connecting elements will be in opposition in each case, i.e. largely opposite each other. The centre is then half way between the grooves of the opposing connecting elements. If three connecting elements are provided, (imagined) tangents that form a triangle may be applied to the groove bottoms of the connecting elements. The centroid of the triangle is an advantageous fulcrum. A similar approach may be used for spacers with five or six connecting elements.

The distance between the bottoms of the connecting-element grooves corresponds to the distance between the connection sites and thus, as a rule, to the breadth or length of the mesh.

Since the ends of the groove walls are spaced further away from the centre of the spacer (distance L1 according to the terminology of this publication) than the groove bottom, problems could arise on insertion of the spacer. The problems are prevented in that, between the securing elements, angular portions are provided in which the securing system has a radial reach L2, which is smaller than L1. This smaller reach must exist in the plane of the first and/or the second groove walls. This smaller reach is also advantageous in the plane of the groove bottom.

It is to advantage if the reach L2 is even smaller than the distance L4 between the principal axis of rotation and the groove bottom. Additional advantages are obtained if L2 is only ¾, ⅔, ½, ⅓ or ¼ of L1.

For the purposes of this publication, each of the distances mentioned is the shortest in one dimension. The following procedure may now be used on insertion of the spacer:

As mentioned, one inserts the securing system of the at least one spacer into a mesh in such a manner that, along the principal axis of rotation, the clamping grooves are at the height of the strand or rod sections of the mesh. In this situation, however, the connecting elements are not pointing towards the later connection sites of the reinforcement strands or rods. Instead, their angular position deviates from the angular position of the connection sites by a first angular magnitude. In the most advantageous embodiment of this teaching, all the securing elements point towards cross-over points of rods or strands of the first reinforcement layer when the securing system is inserted into the at least one spacer. Once the grooves or groove bottoms have reached the plane of the reinforcement layer, the spacer is twisted about its principal axis of rotation and the corresponding strand or rod sections are received into the at least one groove.

As already mentioned, the at least one securing system acts substantially in a first plane E1, meaning that construction tolerances, some of which are considerable, must be taken into consideration when this plane is defined. Furthermore, bonded reinforcement grids of very rigid rods or strands may comprise two planes, e.g. the plane of the strands running horizontally and that of those running at right angles. A person skilled in the art can confront a situation of this kind in different ways. Examples:

a) He may bring the groove axes of the securing elements into different planes that are spaced in the axial direction of the spacer.

b) He may configure the groove to be wide and/or wedge-shaped.

c) He may configure the groove walls to be (very) elastic.

The aforementioned first plane E1, therefore, in which the securing system "acts", may by all means have a notable reach.

By adopting all or some of the measures outlined under points b) and c) above, it is also possible to realise grooves in which, together with the strands 8, a frictional or force fit connection is created which prevents relative movement between the spacer and the reinforcement in the peripheral direction.

In addition, or alternatively, one of the two groove walls may be provided with a protrusion, which projects into the interior of the groove. This protrusion, too, may consist of a flexible material. A protrusion of such kind can create a form-fitting connection, which opposes relative movement between the reinforcement and the spacer also in the peripheral direction. A protrusion of this kind may be referred to as a first latching element.

A groove in the sense of this publication features at least a lower and an upper groove wall and is suitable for receiving a strand or rod of a reinforcement. A groove bottom is advantageous.

It is not imperative for sections of both the lower and of the upper groove walls to be coincident the same angular ranges of the spacer in the peripheral direction. In the peripheral direction, therefore, the one groove wall may accordingly be interrupted in angular portions of the spacer in which the other groove wall is existent. It is often advantageous if, in the peripheral direction, the one groove wall is interrupted in those portions in which the other is existent, and vice versa. However, the various elements of the groove—in this case especially the groove walls—form a functional unit which embraces a connection site of a strand and thus creates the desired connection.

As already mentioned, the connecting elements are spaced from the principal axis of rotation. They may be supported by legs extending outwards from the principal axis of rotation. A disc, preferably a perforated disc, may be used additionally or as an alternative. A disc would advantageously have to lie outside the plane formed by the first groove walls.

The legs, too, would have to offer space in this plane for the angular portions WA, in which the spacer's radial reach is less than L1.

It is advantageous if the spacer is equipped with a limit stop. This limit stop also lies outside the second plane E2, which is defined by the first groove walls. It is beneficial if the limit stop lies in the third plane E3, which is defined by the second groove walls. In this case, the spacer is able to perform an axial movement relative to the reinforcement layer until it hits the limit stop. The first groove walls of the spacer can be guided past the rods of the reinforcement layer such that the groove bottoms lie in the reinforcement plane. In order for the limit stop to be effective, it must, outside the plane E2 and preferably in the plane E3, extend at one or more places beyond the dimensions which the spacer has in the plane E2. If it does this in an angular portion with a connecting element, the end of the limit stop must have a reach L3 that is greater than L1. However, it is more advantageous if the limit stop overlaps angular portions WA in which the spacer only has a reach L2 in the second plane E2 of the first groove walls. In this case, L3 must be greater than L2. Greater advantages are obtained if, here too, L3 is greater or equal to L1.

It is advantageous to connect the at least one distancing body 3 releasably with the securing system. This may be done advantageously using a screwed or snap-in closure (often referred to as a "clip closure").

It is advantageous to distribute the securing elements uniformly around the principal axis of rotation in the peripheral direction. As a rule, this means that the securing elements have the same angular distances between them. In the case of two securing elements the angular distance between them would thus be 180°, in the case of three it would be 120°, in the case of four 90°, and so on.

It is expedient for all embodiments of the invention if the components of the spacer(s) are integrated in a system. This means, for one thing, that the at least one securing system and the reinforcement layer—or reinforcement layers, as the case may be—are advantageously well coordinated with each other. Individual measures that are advantageous in this context include coordinating the dimensions of the meshes in the reinforcement system with the distances between the connecting elements of the at least one securing system and coordinating the cross-sectional area and shape of the rods in the reinforcement with the dimensions and cross-sectional area of the grooves of the connecting elements.

In the context of a distancing system, it is also advantageous to coordinate the nature of securement of the least one distancing body with its reach, at least in the spacer's axial direction. Many preferred embodiments of the invention will comprise spacers featuring at least two securing systems that are axially offset relative to one another. Spacers of this kind can keep at least two reinforcement layers mutually spaced apart. An additional advantage is obtained if the distance between the at least two reinforcement layers and the formwork can be adjusted by means of the aforementioned distancing body. This may be effected using at least one additional distancing body. If large numbers of spacers customized in this way to meet specific requirements are needed, it is cost-effective to have them supplied in prefabricated form. Spacers are often integrally formed.

For other applications, however, it is advantageous to provide distancing bodies with different dimensions (in particular, once again, with different axial lengths), and to combine them with securing systems as required. Distancing bodies may also be cut to specific lengths.

The spacers and their components, such as distancing bodies and securing systems, preferably consist of plastic or fibre-reinforced plastic and are conveniently fabricated by way of injection moulding.

In many reinforcement systems the spacer's principal axis of rotation will run through the geometric centre of the mesh of the reinforcement, into which the respective spacer is inserted. It is also advantageous to combine at least two reinforcement layers, without them being axially distanced from one another, by means of a securing system. In this case, the reinforcement strands or bars are lodged one above the other in the grooves of the securing system.

The spacers, reinforcement systems and methods described in this publication offer special advantages in combination with reinforcement material containing fibres (carbon fibres, glass fibres, basalt fibres, etc., also often referred to as textile reinforcement). This may apply to the extent that metal-free reinforcements are used with preference.

In the case of textile reinforcements, as they are generally termed, unlike with heavier steel reinforcements, the problem of "upward floating" may be encountered. After the concrete has been poured, the reinforcement system floats upwards, away from the bottom of the formwork, and is thus no longer at the correct distance from the limiting surfaces of the concrete component. A second distancing body, which is weighted from above in the formwork or which, e.g., is pressed downwards by formwork components, may be used to prevent the reinforcement from floating upwards. The lightweight textile reinforcement system is thereby fixed reliably at the desired position in the concrete component.

In many embodiments of the invention, a first form-fitting connection between the first reinforcement layer and the at least one securing system is created as early as the moment when, during the twisting process, the first reinforcement strand engages the first groove. This form-fitting connection acts in the spacers axial direction. At the same time, or as twisting continues, friction generally occurs between the groove walls and the reinforcement strands or rods (this will depend on the shape and size of the grooves and of the reinforcement strands or rods) and a frictional connection builds up. This then opposes a "return movement" of the spacer relative to the first reinforcement layer in the spacer's peripheral direction. Alternatively, or in addition, at least one groove may be provided with a latching element.

The technical features of the individual embodiments can, as a rule, be used advantageously with all the embodiments of the invention.

A few selected embodiments of the invention are explained below by reference to the drawings.

Figure 1:
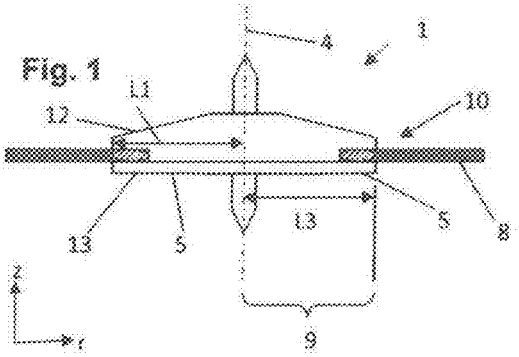
FIG. 1 shows the A-A section through FIG. 3.
Figure 2:
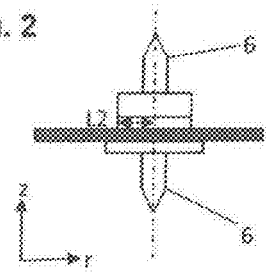
FIG. 2 shows a side view (view B from FIG. 3) of a first embodiment of the spacer, which is located in a mesh.
Figure 3:
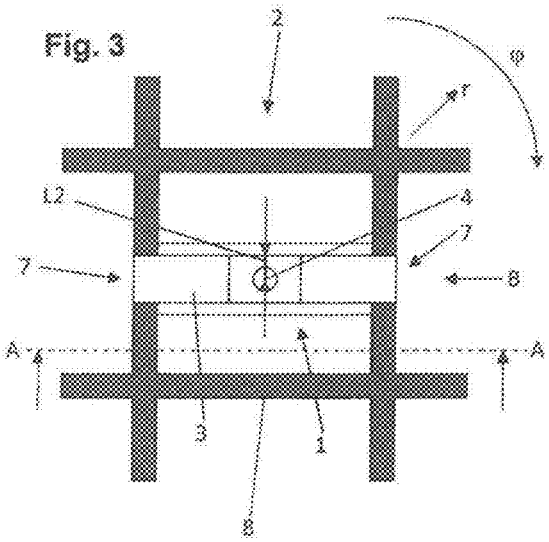
FIG. 3 shows a top view of a first basic embodiment of the spacer, which is located in a mesh.

FIG. 3 shows a top view of a first basic embodiment of the spacer 1, which is located in a mesh 2 and is also shown in FIGS. 1 and 2. In FIG. 3, it is predominantly the securing system 3 of the spacer 1 that is visible. This securing system forms a bridge between the connection sites 7, at which the grooves 10 of the securing system embrace the strands 8 of the mesh 2. The securing system comprises two legs 5, which meet at the principal axis of rotation 4. The curly bracket 9 indicates the length of a leg 5. The grooves 10, which, terminologically speaking, are part of the connecting elements 11, are at the leg ends further away from the principal axis 4 (=in the positive radial direction). The first embodiment of a spacer illustrated in FIGS. 1 to 3 is provided with two distancing bodies 6. These two elongate bodies 6 extend along the same line as the principal axis of rotation 4. The strands of the mesh are only shown in simplified form in FIGS. 1 to 3, and in some of the other drawings they have been left out altogether for reasons of clarity.

The drawings described so far show the reach L1, between the principal axis of rotation 4 and the end 22 of the first groove wall 12, of the securing system 3. This is greater than the reach L2 which the securing system 3 has in the angular sections WA between the securing elements. In this first embodiment, as shown in FIGS. 1 to 3, L1 is also equal to L3. L3 is the reach which the securing system 3 has between the principal axis of rotation 4 and the end of the second groove wall 13. This simple embodiment serves for the explanation of the basic principle of the insertion of the spacer through rotational movement. Furthermore, only the following embodiments show all features of the claimed spacer.

Figure 4:
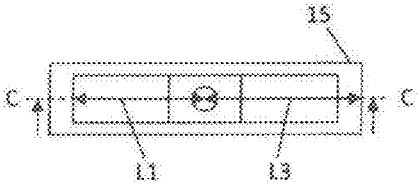
FIG. 4 shows a top view of the first basic embodiment of the spacer, without the mesh shown in FIGS. 1-3 but with a limit stop.
Figure 18:
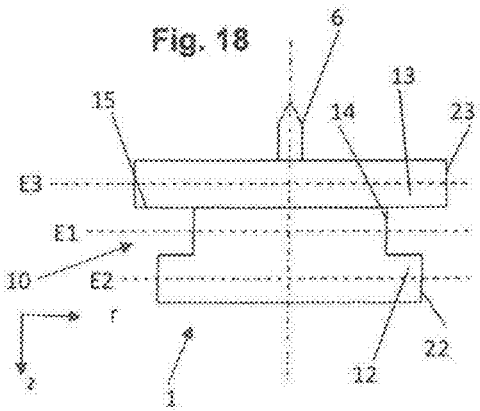
FIG. 18 shows a section (C-C in FIG. 4) (first embodiment, but with a limit stop).

FIGS. 4 and 18 show a slightly modified first embodiment, in which L3 is greater than L1. The second groove wall 13 of the illustrated spacer 1 is longer than the first groove wall 12, meaning that the second groove wall 13 can simultaneously serve as the limit stop 15.

When the spacer is inserted into a mesh 2, the limit stop 15 ends the relative movement between the spacer 1 and the mesh 2. At this point, the first plane E1 of the groove bottoms 14 is on a level with the strands 8 forming the mesh 2. At this level (=position in the axial direction), the spacer 1 undergoes a twisting movement about its principal axis of rotation 4 in the peripheral direction φ to the effect that portions of the strands 8 are hosted in the grooves 10 at the connection sites 7, thereby establishing the desired connection between the spacer 1 and the mesh 2 of the first reinforcement layer.

Figure 5:
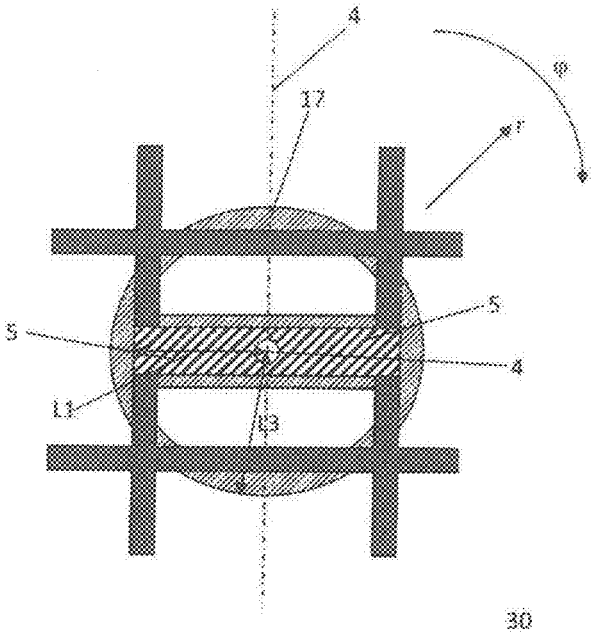
FIG. 5 shows a top view of a second embodiment of the spacer, which is located in a mesh.

FIG. 5 shows a second embodiment of the spacer 1, which only differs from the spacer 1 shown in FIGS. 1 to 3 in that the limit stop 17 is circular. This limit stop is a highly advantageous refinement of the previously mentioned limit stop 15. The limit stop 17, too, has a reach L3, which is again greater than L1, in the spacer's radial direction. This reach L3 is also the same as the radius of the circular limit stop 17 in the third plane L3 of the second groove walls 13. The size of the limit stop 17 is coordinated with the mesh 2 in such manner that, in the limit-stop position, a relatively large contact surface is obtained between the mesh 2 and the circular limit stop. The detent mechanism for a spacer 1 of this kind is shown again in FIGS. 6 and 7, which disclose a third embodiment of the spacer 1. Unlike the embodiment of FIG. 5, which features two legs 5 associated in each case with a connecting element 11 having a groove 10, the third embodiment has four legs 5 associated in each case with a connecting element 11 having a groove 10. The angular distance in each case between the legs 5, securing elements 11 and the grooves is 90° (180° in FIG. 5).

Figure 6:
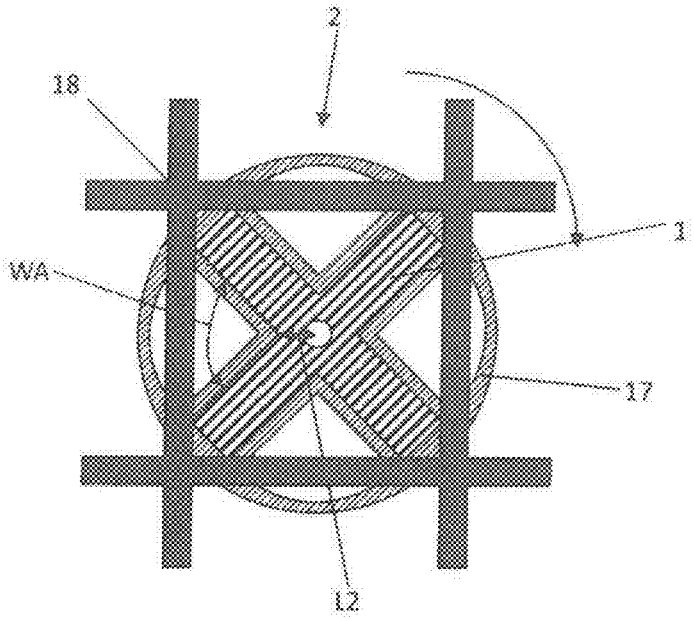
FIG. 6 shows a top view of a third embodiment of the spacer, which is located in a mesh.

FIG. 6 shows the situation in which the spacer 1 is being inserted into the mesh 2. At this moment, the securing elements 11/grooves 10 of the securing system 3 are pointing towards the cross-over points 18 of the strands 8 forming the mesh. In the embodiment shown in FIG. 6, it is hardly possible to insert the spacer into the mesh at angular positions in which the connecting elements 11 are not pointing relatively accurately towards the cross-over points 18.

It goes without saying that functional pairs made up from the first reinforcement layer 16 and the spacer 1 are possible, where the spacer can be inserted into the first reinforcement layer even if the connecting elements 11, or the grooves 10, point towards strand portions located between the cross-over points 18 and/or the connection sites 7, i.e. are at angle of 45° or 30° to the cross-over points 18 and/or the connection sites 7.

Figure 7:
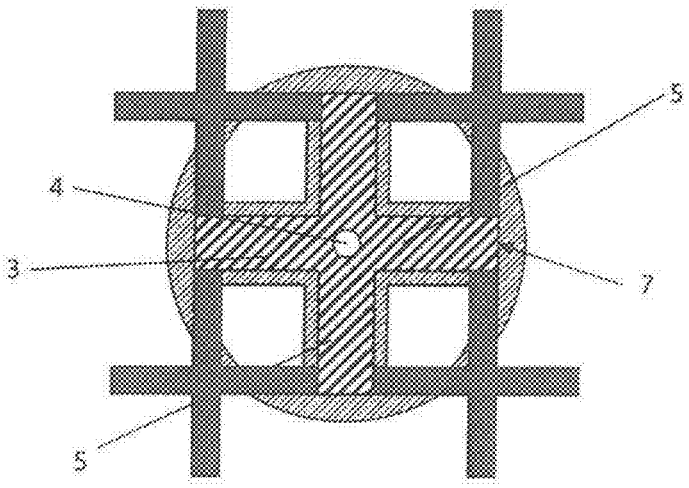
FIG. 7 shows a top view of a third embodiment of the spacer, which has reached its end position in a mesh.

FIG. 7, ultimately, shows the spacer and the mesh from FIG. 6 after the spacer has been twisted onto the strands of the reinforcement layer and thereby locked onto it.

Figure 8:
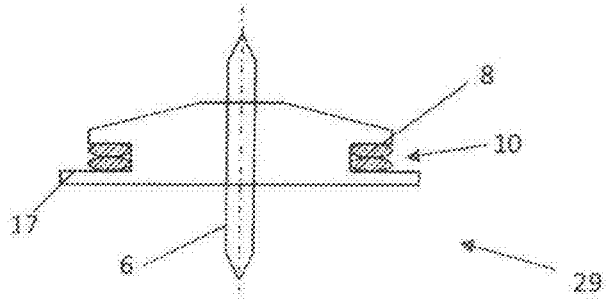
FIG. 8 shows a side view of a fourth embodiment of a spacer, whose grooves embrace two reinforcement layers.

FIG. 8 shows a section through a reinforcement system providing a fourth embodiment of a spacer 1, in which two reinforcement strands 8 are held in each of its grooves 10.

Figure 9:
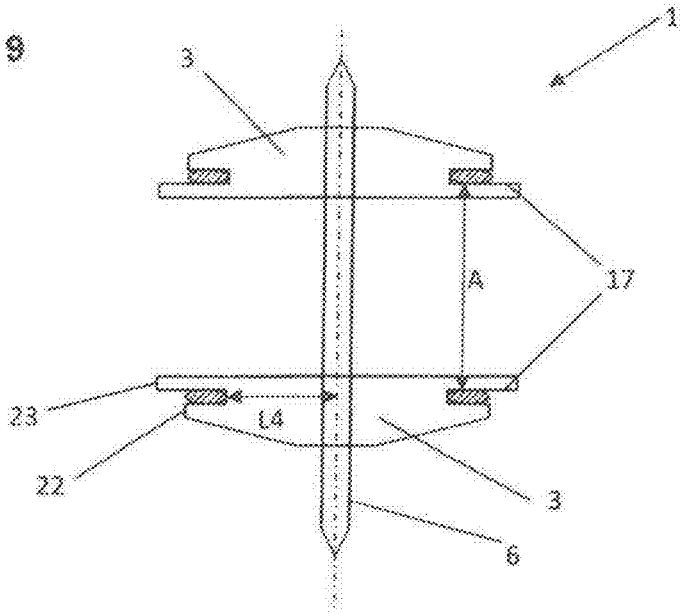
FIG. 9 shows a side view of a fifth embodiment of a spacer, which comprises two securing systems.

FIG. 9 shows a spacer 1 that has two securing systems 3. These are arranged such as to be mutually mirror-inverted, i.e. the position of the two circular limit stops 17, in particular, is mirror-inverted, which is advantageous particularly for the first and last securing systems 3 of a spacer.

Figure 10:
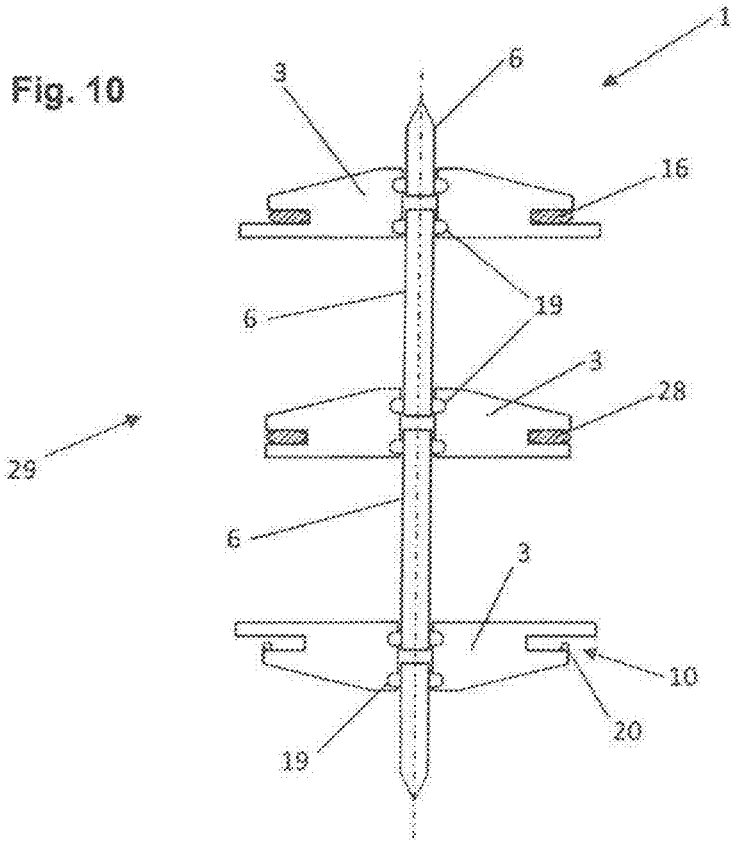
FIG. 10 shows a side view of a sixth embodiment of a spacer, which comprises three securing systems.

FIG. 10 shows a spacer 1 built up in modular design. This spacer has a plurality of distancing bodies 6, which are attached releasably to the securing systems. This if effected with the help of latching elements 19, which preferably engage in notches (not shown) and create snap-in connections. The male latching element may be attached either to the distancing body 6 or to the securing system 3. FIG. 10 also shows the latching element 20 of the groove 10, which projects from one groove wall into the groove 10 and can help to secure strands 8 or rods in the groove 10. FIG. 10 furthermore shows that, on the basis of this invention, it is possible to create a distancing system with different distancing bodies 6 and securing systems 3, making it possible to fulfil all sorts of different requirements.

Figure 11:
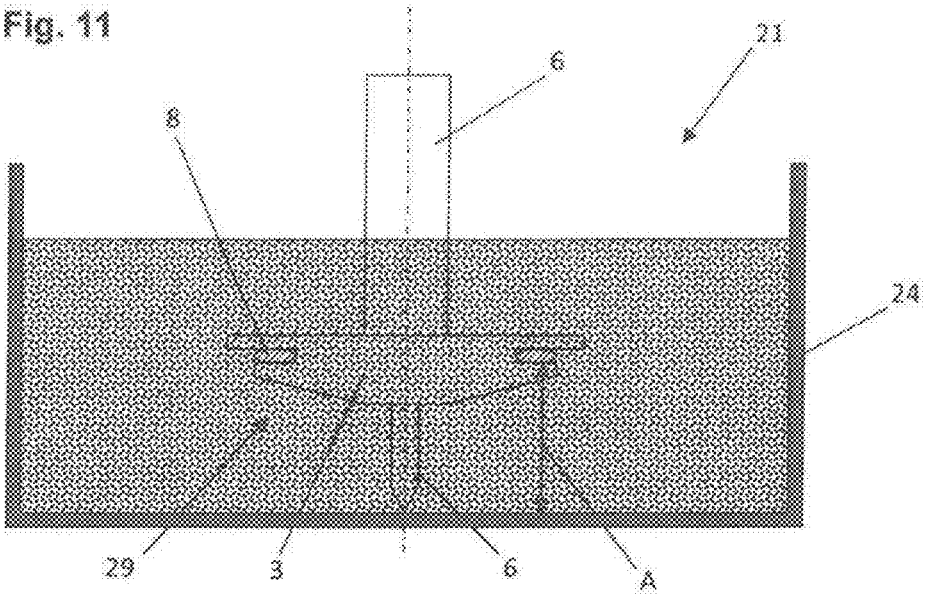
FIG. 11 shows a section through a concrete component in its formwork.

FIG. 11 shows a section through a concrete component 21 in its formwork 24.

Figure 12:
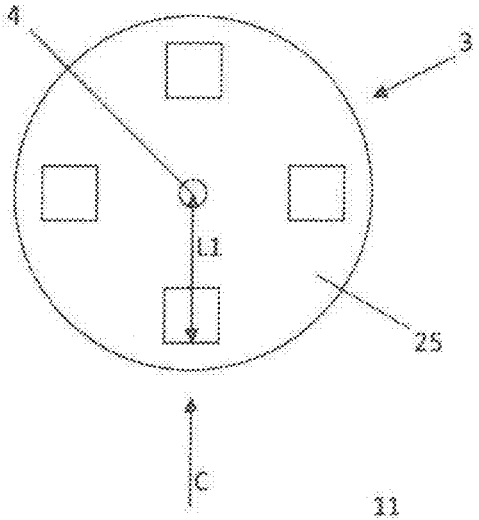
FIG. 12 shows a top view of a seventh embodiment of a spacer, where the securing system is configured like a disc.
Figure 13:
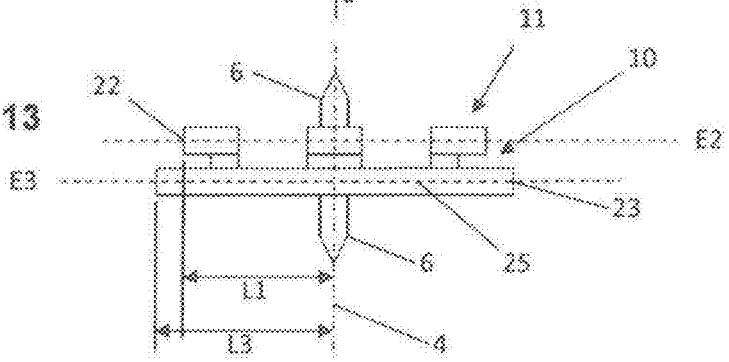
FIG. 13 shows the seventh embodiment of a spacer from the side.

FIGS. 12 and 13 show a further embodiment of a spacer, in which the securing system comprises a disc 25 on which the connecting elements 11, which in turn comprise grooves 10, are arranged. The side view in FIG. 13 discloses that the disc 25 extends only along the third plane E3 of the second groove walls 13. The disc 25 carries the connecting elements 11, which in turn—here—each form and/or comprise a groove 10. The connecting elements are again distributed uniformly over the circumference of the spacer. The spacer shown requires no legs 5, which may also extend along the planes E1 or E2. The disc 25 may also feature perforations that make it easier for concrete to flow through it.

Figure 14:
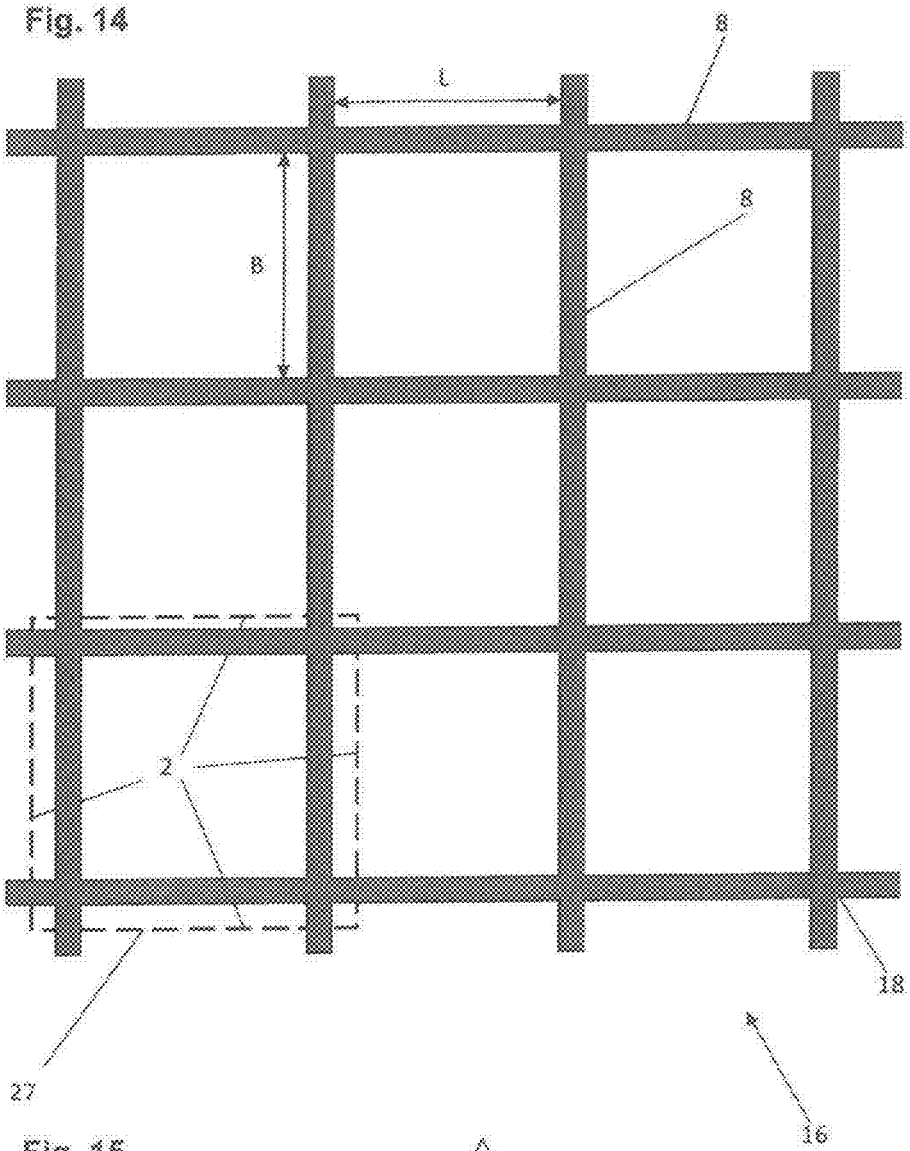
FIG. 14 shows a systematic top view of a plurality of reinforcement meshes.

FIG. 14 once again shows a reinforcement layer 16 of strands 8, which intersect at cross-over points 18. A person skilled in the art would refer to the reinforcement layer 16 shown in FIG. 14 as a grid. The meshes 2 are square; however, they may also be rectangular—that is, have a length L that differs from the breadth B. Textile reinforcement layers—i.e. those that comprise fibrous material or consist exclusively thereof, may be brought into "grid shape" in the form of bonded or woven fabrics. Steel reinforcing mats are usually bonded. The square 27 (dashed line) indicates the scope of the term "mesh".

The spacers according to the invention are suitable both for textile and for conventional reinforcement layers of steel or the like. However, the additional advantages in the field of textile reinforcement layers must be emphasized.

Figure 15:
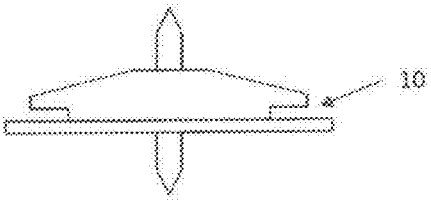
FIG. 15 shows a basic embodiment of a spacer from the side and serves to clarify the terms used.

FIG. 15 once again shows a spacer 1 from the side and clarifies the terms used in this publication.

Figure 16:
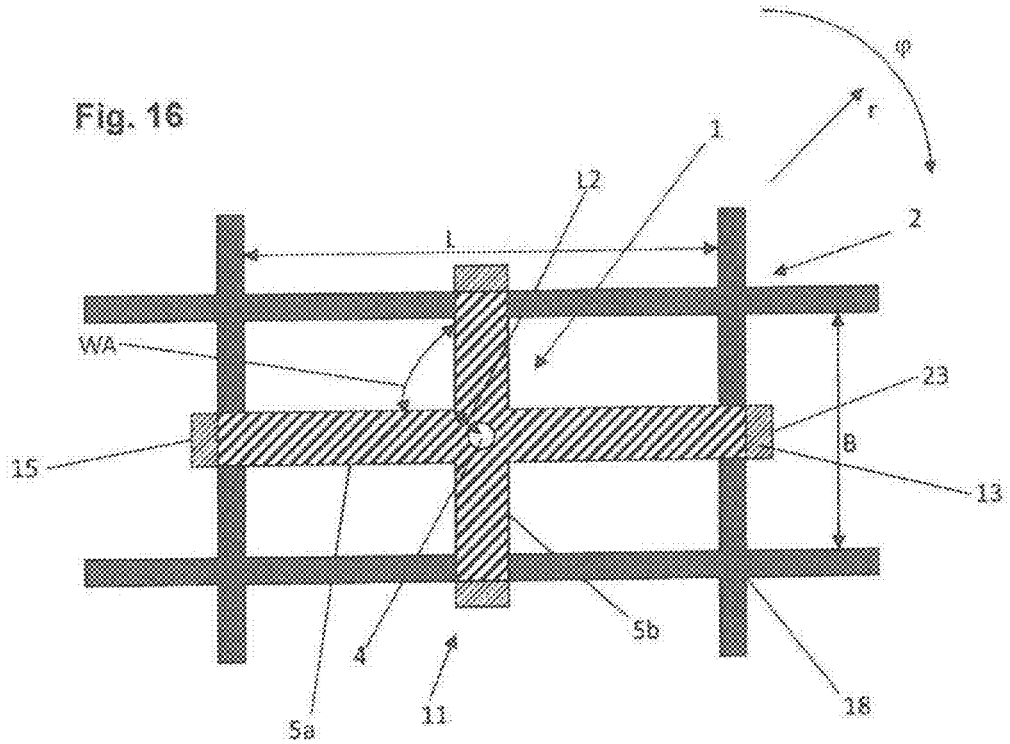
FIG. 16 shows a top view of a further embodiment of a spacer, which is optimised specifically for rectangular meshes.

FIG. 16 shows a rectangular mesh in which the length L is greater than the breadth B and in which an appropriately adapted spacer 1 has been inserted. This has two long legs 5*a* along the length L and two short legs 5*b* along the breadth B. The centre of the spacer 1 is the principal axis of rotation 4, which coincides with the centre of the mesh 2 and passes through it. The spacer 1 of FIG. 16 is again provided only with limit stops 15 that are nothing more than an elongated second groove wall 13. From the design of its connecting elements 11 at the ends of the legs 5*a*, 5*b*, FIG. 16 is insofar reminiscent of FIGS. 4 and 5.

FIG. 16 also serves to explain circumstances that apply to many embodiments of the invention:

Two of the four connecting elements 11, or their grooves 10, point outwards in the longitudinal direction L while two point outwards in the widthwise direction B. One could also say that the connecting elements 11 pointing in the widthwise direction B and in the longitudinal direction L form a pair in each case and are in opposition. If one of the two connecting elements 11 of the pair comes into contact with the associated strand 8 of the mesh 2 when the spacer 1 is twisted about it principal axis of rotation 4, an opposing force is generated that acts on the other connecting element of the pair and promotes the formation of a connection between it 11 and the associated strand 8. This is why it is advantageous to arrange pairs of connecting elements in the manner described.

The arrow denoted by L2 in FIG. 16 is also of general importance to the whole invention. L2 is smaller than L4 in the entire angular portion WA between the two connecting elements 11 or securing elements. The arrow was drawn at the point where L2 is smallest. In FIG. 6, the angular portion or angular section WA between two connection sites 7 and L2 was drawn in the same manner.

Figure 17:
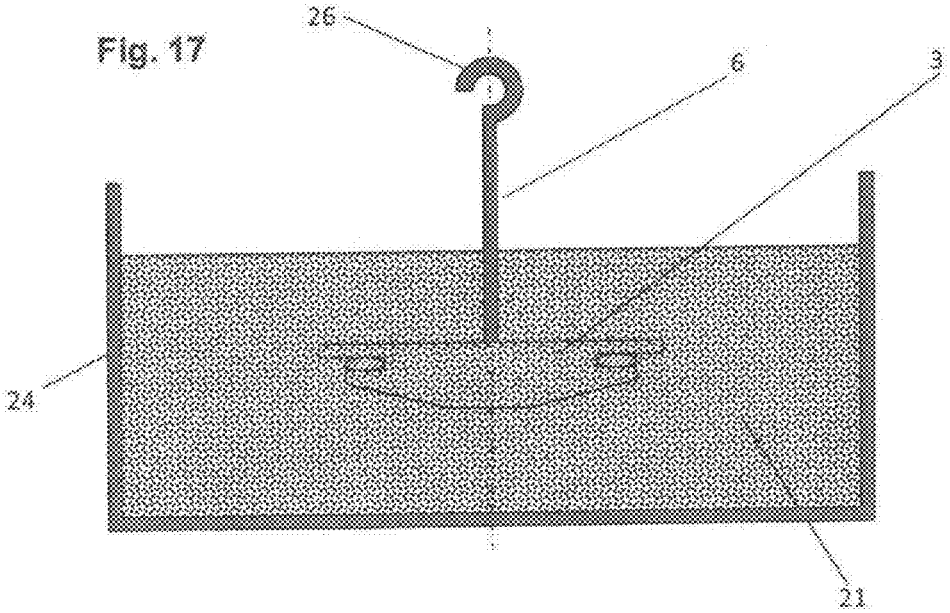
FIG. 17 shows a spacer suspended in formwork with a distancing body shaped as a hook.

FIG. 17 shows a further section through a concrete component 21 in its formwork 24. The concrete component is provided with a special distancing body 6. As already mentioned, the term "distancing body" is first and foremost a functional term. Most of the distancing bodies 6 are cylindrical in the drawings described so far. Furthermore, these bodies extend along the principal axis of rotation 4. Distancing bodies may, however, also run parallel to this axis, the most important thing being that they reach in the axial direction z. The distancing body 6 in FIG. 17 is provided with a hook 26 that can be hung on a wire, for example (other means, such as an eyelet, for securing the distancing body to a wire or rope are also conceivable. This hook 26 imparts a tensile load to the whole of the distancing body 6, enabling the entire spacer 1 and thus also the reinforcement 16 to be suspended during encasement in concrete.

By contrast, the distancing bodies 6 already shown in the illustrated embodiments primarily take up compressive loads.

Figure 19:
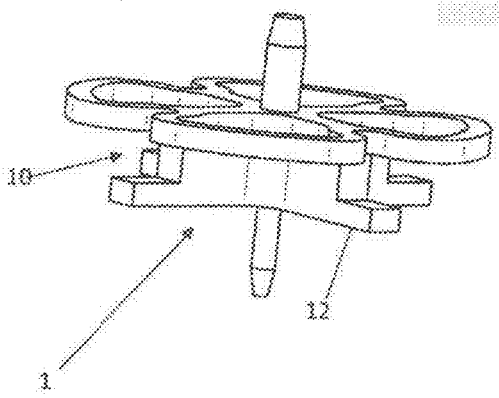
FIG. 19 shows a perspective drawing of a further embodiment of a spacer.
Figure 20:
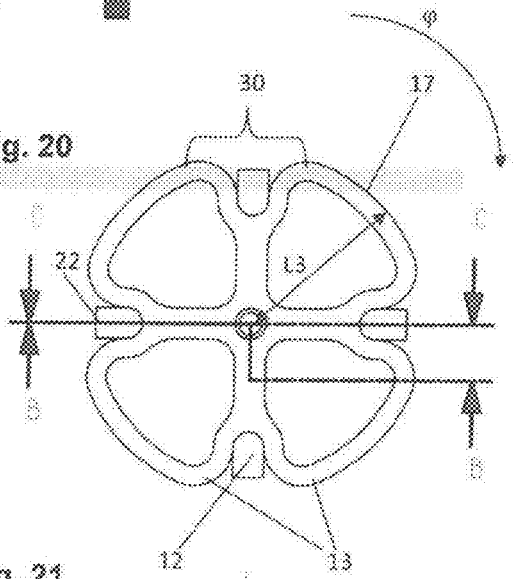
FIG. 20 shows a top view of the embodiment already shown in FIG. 19.
Figure 21:
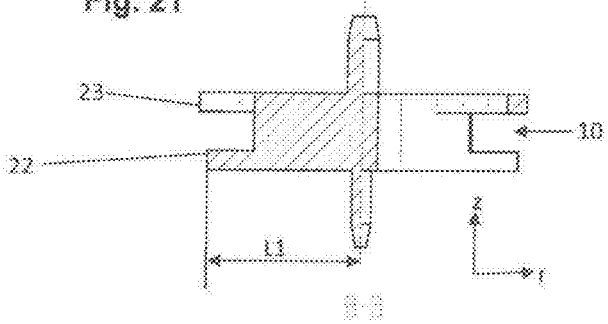
FIG. 21 shows a section (BB in FIG. 20) of the embodiment already shown in FIGS. 19 and 20.

FIG. 19 shows a perspective view of another spacer 1, which is also depicted in FIGS. 20 and 21. This spacer 1 has grooves 10 that are limited in the axial direction z of the spacer 1 by first 12 and second groove walls 13. In the embodiment shown, however, the first groove wall 12 is interrupted in those portions of the peripheral direction φ in which the second groove wall 13 is existent and vice versa (the interruption thus reaches primarily in the radial and peripheral directions). This measure brings advantages in the production of spacers 1 by injection moulding and is accordingly applicable to all embodiments of the spacers 1 according to the invention. The second groove walls 13 are simultaneously part of the circular limit stop 17, which is interrupted in the peripheral direction φ at those points where the first groove wall 13 is existent (strictly speaking, the limit stop is no longer circular). The curly bracket 30 indicates the clasping portion of the groove 10. In this clasping portion, the groove 10 embraces the connection site 7 of a strand 8 of the first reinforcement layer 16. One could also say that the curly bracket 30 denotes the portion, in the peripheral direction φ, in which the groove 10 is effective (functional portion of the groove 10). The clasping portion thus arises here from the portion in which the first and/or second groove wall embraces the strand and in so doing creates a form-fitting connection in the spacer's axial direction z.

The strand 8, which is only shown in FIG. 10, has been left transparent in this drawing so that the groove walls 12, 13 remain visible.

List of reference numerals

| | | | |
|---|---|---|---|
| 1 | Spacer | | |
| 2 | Mesh | | |
| 3 | Securing system | | |
| 4 | Principal axis of rotation | | |
| 5 | Leg | 5a Long leg | 5b Short leg |
| 6 | Distancing body | | |
| 7 | Connection sites | | |
| 8 | Strand | | |
| 9 | Curly bracket | | |
| 10 | Groove | | |
| 11 | Connecting element | | |
| 12 | First groove wall | | |
| 13 | Second groove wall | | |
| 14 | Groove bottom | | |
| 15 | Limit stop | | |
| 16 | First reinforcement layer | | |
| 17 | Circular limit stop | | |
| 18 | Strand cross-over points | | |
| 19 | Latching element of distancing body | | |
| 20 | Latching element of groove | | |
| 21 | Concrete component | | |
| 22 | End of first groove wall | | |
| 23 | End of second groove wall | | |
| 24 | Formwork | | |
| 25 | Disc | | |
| 26 | Hook | | |
| 27 | Dashed square | | |
| 28 | Second reinforcement | | |
| 29 | Reinforcement system | | |
| 30 | Curly bracket: clasping/functional portion of groove 10 | | |
| A | Distance reinforcement layer 16 - other body: | | |
| B | Breadth of mesh | | |
| L | Length of mesh | | |
| L1 | Reach of securing system 3 from the principal axis of rotation 4 | | |

-continued

| List of reference numerals | |
|---|---|
| | to the end 22 of the first groove wall 12 |
| L2 | Reach of securing system 3 in the angular portion WA between the connecting elements 11 |
| L3 | Reach of securing system 3 from the principal axis of rotation 4 to the end 23 of the second groove wall 13 |
| L4 | Reach of the securing system 3 from the principal axis of rotation 4 to the groove bottom 14 |
| E1 | Plane in which a securing system 3 acts |
| E2 | Plane defined by the first groove walls 12 |
| E3 | Plane defined by the second groove walls 13 |
| r | Radial coordinate in cylindrical coordinate system, radial direction of the spacer 1 |
| φ | Angular coordinate in cylindrical coordinate system, peripheral direction of the spacer 1 |
| z | Height coordinate in cylindrical coordinate system, axial direction of the spacer 1 |

The invention claimed is:

1. A Spacer (1) for a first reinforcement layer (16), with which (1) a distance, in the spacer's axial direction (z), between the first reinforcement layer (16) and at least one other body (24, 28) is adjustable and comprising:

at least one distancing body (6) extending in the axial direction (z), at least one securing system (3), which acts substantially in a first plane (E1) defined by a peripheral direction (j) and a radial direction (r) of the spacer (1) and which is connected to the distancing body (6), the securing system (3) having at least two connecting elements (11) for strands (8) or rods of the first reinforcement layer (16), each of the connecting elements (11) having at least one groove (10) featuring a first (12) and a second (13) groove wall, whose longitudinal axis runs in the peripheral direction (j) of the spacer (1) and whose opening points outwards in the radial direction (r), the spacer (1) having a principal axis of rotation (4) running in the axial direction (z), ends (22) of the first groove walls (12) in the radial direction (r) being spaced from the principal axis of rotation (4) by distances (L1), and the first groove wall (12) having a portion being substantially flat that opposes the second groove wall (13), and, in angular portions (WA) lying between the connecting elements (11) in the peripheral direction (j), the securing system (3) having a reach (L2) which, in the radial direction (r) in the second plane (E2) defined by the first groove walls (12), is smaller than the distance (L1), at least one limit stop (15), which is located outside the plane (E1) defined by the first groove walls (12) and whose edge, at the end facing radially (r) away from the principal axis of rotation (4), is spaced from the principal axis of rotation (4) by a distance L3, which is greater than L1.

2. The Spacer (1) according to claim 1, wherein the at least two connecting elements (11) are attached at the ends of legs (5), which run in the radial direction (r) and/or the at least two connecting elements (11) are carried by a disc (25).

3. The Spacer (1) according to claim 1, wherein at least one of the two groove walls (12, 13) of at least one groove (10) of the spacer (1) is elastically deformable, at least section-wise, during insertion of a fibre strand (8).

4. The Spacer (1) according to claim 1, wherein at least one of the two groove walls (12, 13) of at least one groove (10) of the spacer (1) is provided with a protrusion (20), which projects into the interior of the groove (10).

5. The Spacer (1) according to claim 1, wherein the at least one distancing body (6) is connected releasably to the at least one securing system (3).

6. The Spacer (1) according to claim 1, wherein the at least two connecting elements (11) of at least one securing system (3) of the spacer (1) are distributed uniformly around the principal axis of rotation (4) in the peripheral direction (φ).

7. The Spacer (1) according to claim 1, wherein at least two securing systems (3), which are offset relative to one another in the axial direction (z) and are connected releasably or inseparably and, in the peripheral direction (j), rotatably or rigidly by distancing elements (6).

8. A Reinforcement system (29) for a concrete component, the system comprising:

a first reinforcement layer (16) comprising reinforcement strands (8) or reinforcement rods (8) that intersect at cross-over points (18), a plurality of strand or rod sections (8), each of which extends between two adjacent crossover points (18), forming a mesh (2) of the reinforcement layer (16), at least one spacer (1) according to claim 1 featuring an axially (z) extending distancing body (6) and at least one securing system (3), which is connected to the distancing body (6), and at least one limit stop (15), which is located outside the plane (E1) defined by the first groove walls (12) and whose edge, at the end facing radially (r) away from the principal axis of rotation (4), is spaced from the principal axis of rotation (4) by a distance L3, which is greater than L1, wherein the securing system (3) comprising at least two connecting elements (11), each with at least one groove (10) in which at least one strand or rod section (8) of the mesh (2) of the reinforcement layer (16) is accommodated at a connection site (7) of the strand or rod section, and the limit stop (15) being in contact with the reinforcement layer (16), wherein the distance between the connection sites (7) and the geometric centre of the mesh (2) being smaller than the distance between the geometric centre and the cross-over points (18) of the reinforcement layer mesh (2), and wherein the distance between the (16) and a further body (24, 28) being adjustable by the distancing body (6).

9. The Reinforcement system (29) according to claim 8, wherein the reinforcement system has at least two reinforcement layers (16) with or without a space between them and the at least one spacer (1) is directly connected with the at least two reinforcement layers (16).

10. The Reinforcement system (29) according to claim 9, wherein the reinforcement contains fibre strands.

11. A Method for production of a reinforcement system (29), the method comprising:

Provision of a reinforcement (16) comprising strands or rods (8) that intersect at cross-over points (18), a plurality of strand or rod sections (8), each of which extends between two adjacent cross-over points (18), forming a mesh (2) of the reinforcement, Provision of at least one spacer (1) according to claim 1 comprising at least one distancing body (6) extending in its axial direction (z), a limit stop (15), which is located outside the plane (E1) defined by the first groove walls (12) and whose edge, at the end facing radially (r) away from the principal axis of rotation (4), is spaced from the principal axis of rotation (4) by a distance L3, which is greater than L1, and at least one securing system (3), the securing system (3) comprising at least two connecting elements (11) each of which has at least one groove (10) whose longitudinal axis runs in the peripheral direction (j) of the spacer (1) and whose opening points outwards in the radial direction (r), Insertion of the securing system (3) of the at least one spacer (1) into the mesh (2) in such a manner that, along the principal axis of rotation (4), the grooves (10) are at the height of the strand or rod sections (8) of the mesh (2), Twisting of the spacer (1) about its principal axis of rotation (4), the corresponding strands or rod sections (8) being received into the at least one groove (10).

12. Method according to claim 11, wherein the twisting movement is continued until the groove walls secure the strand or rod section in position.

13. Method according to claim 12, wherein on insertion into the mesh (2), each of the connecting elements (11) of the securing system (3) is oriented towards a cross-over point (18) of the reinforcement (16).

* * * * *